United States Patent [19]

Montgomery et al.

[11] Patent Number: 5,009,323

[45] Date of Patent: Apr. 23, 1991

[54] TAMPER INDICATING CLOSURE HAVING A ROTARY SEAL

[75] Inventors: Gary V. Montgomery; Terry E. Beck, both of Evansville, Ind.

[73] Assignee: Sunbeam Plastics Corporation, Evansville, Ind.

[21] Appl. No.: 435,261

[22] Filed: Nov. 13, 1989

[51] Int. Cl.[5] ..... B65D 41/34

[52] U.S. Cl. ..... 215/252; 215/341; 215/343; 215/354; 222/545; 222/546; 222/570

[58] Field of Search ..... 215/252, 211, 270, 341, 215/354, 253; 222/545, 546, 562, 570

[56] References Cited

U.S. PATENT DOCUMENTS

| | | | |
|---|---|---|---|
| 3,463,341 | 8/1969 | Fields | 215/42 |
| 3,693,847 | 9/1972 | Gibson | 222/546 |
| 3,762,612 | 10/1973 | Miller | 222/479 |
| 3,980,195 | 9/1976 | Fillmore | 215/256 |
| 4,033,472 | 7/1977 | Aichinger | 215/256 |
| 4,126,240 | 11/1978 | Brach | 215/252 |
| 4,322,011 | 3/1982 | Mumford | 215/270 |
| 4,322,012 | 3/1982 | Conti | 215/344 |
| 4,546,893 | 10/1985 | Stull | 215/252 |
| 4,572,387 | 2/1986 | Luker et al. | 215/252 |
| 4,592,475 | 6/1986 | Hannon et al. | 215/252 |
| 4,625,875 | 12/1986 | Carr et al. | 215/232 |
| 4,749,095 | 6/1988 | Rote | 215/252 |
| 4,771,904 | 9/1988 | Perne et al. | 215/252 |
| 4,784,280 | 11/1988 | Breuer et al. | 215/252 |

FOREIGN PATENT DOCUMENTS

| | | |
|---|---|---|
| 0004500 | 10/1979 | European Pat. Off. . |
| 1955047 | 5/1971 | Fed. Rep. of Germany . |
| 1536459 | 7/1968 | France . |
| 1593072 | 7/1981 | United Kingdom . |

*Primary Examiner*—Stephen P. Garbe
*Assistant Examiner*—Stephen K. Cronin
*Attorney, Agent, or Firm*—Gifford, Groh, Sprinkle, Patmore and Anderson

[57] ABSTRACT

A closure including a standard threaded cap having a tamper indicating band depending from the cap skirt by frangible webs. The tamper indicating band has an inwardly directed bead which cooperates with a flange on the container neck which allows the band to rotate with the cap but prevents the band from being removed past the container flange. Alternatively the tamper indicating band contains spaced ratchet teeth which engage ratchet teeth on the container neck to prevent further rotation. A rotary seal is provided between the cap and container neck which is effective for an axial length A greater than the sum of a distance B between the cap bead and the container flange when the cap is tightened or the axial movement of the cap in rotating the ratchet teeth into contact and the distance C which the frangible webs stretch before fracture. Thus the rotary seal prevents access to the product prior to breaking the tamper indicating band loose from the cap.

10 Claims, 3 Drawing Sheets

TAMPER INDICATING CLOSURE HAVING A ROTARY SEAL

BACKGROUND OF THE INVENTION

1. Field of the Invention

This invention relates to tamper indicating closures. More particularly, the invention relates to tamper indicating closures of the type in which a tamper indicating band is spaced from the bottom of the cylindrical skirt of a standard threaded cap by a number of circumferentially spaced frangible webs. The band has an inwardly directed bead which engages a flange on the container neck below the threads when the cap is initially threaded onto the container. When the cap is unthreaded, the bead on the tamper indicating band engages the flange on the container neck preventing axial movement of the band past the container flange as the cap is being threaded off so that the webs are stretched and fractured leaving the band on the container neck as the cap is removed. As an alternative to an inwardly directed bead on the tamper indicating band, spaced ratchet teeth can be used which engage spaced ratchet teeth on the container neck. Stop surfaces on the ratchet teeth engage, preventing further rotation and axial movement so that the webs are stretched and fractured.

2. Description of the Related Art

Conventional sealing means have been used with this type of tamper indicating closure such as a gasket located in the cap which compresses between the top of the cap and the container lip. Other types of seals have been used such as a flange or fin which is molded integrally with the cap top engaging the container lip or a plug which depends from the cap engaging inside of the container neck have also been used. Normally these conventional seals are satisfactory since the seal integrity is maintained until initial opening and they can be resealed after the tamper indicating band has been fractured from the cap by merely applying the initial sealing force. However, it has been discovered that when this type of closure is applied to a plastic container having a liquid product, that the cap can be backed off or unthreaded sufficiently to break the seal before the frangible webs are broken particularly if pressure is applied to the plastic bottle to force the liquid past the seal. This has caused a problem with the packaging of such products as liquor products in which the closure can be partially unthreaded to allow the removal of a portion of the product by squeezing the container walls and replacing the removed products with water by immersing the closure in water and releasing the depressed or deformed container. When the closure is returned to its tightened condition, there is no evidence of tampering.

It is to the solution of this tampering problem that the present invention is directed.

SUMMARY OF THE INVENTION

This invention provides an improvement in a tamper indicating closure having a conventional cap with a top and annular skirt with a tamper indicating band spaced from the bottom of the skirt and connected by circumferentially spaced axially extending frangible webs. The tamper indicating band has an engagement element usually in the form of an inwardly directed bead which snaps over a container flange below the threads or ratchet teeth which engage complimentary ratchet teeth on the container neck which prevents movement of the band past the flange or the ratchet past each other when the cap is unthreaded, breaking the frangible webs in tension or shear as they are stretched. A rotary sealing member is provided on the cap which maintains sealing contact with the container neck from a fully threaded position of the cap on the container neck in which the bead is spaced from the container flange or the complimentary ratchet teeth are spaced apart to the point of web fracture. This requires the rotary sealing element to remain effective for an axial movement of the cap of a distance greater than the sum of a distance B equal to the space between the bead and container flange when the cap is fully threaded onto the container or the axial movement of the cap in rotating the ratchet teeth into contact and a distance C to which the webs are stretched when the bead is in contact with the container flange or the ratchet teeth are in contact in the unthreading process before fracture of the frangible webs.

In one embodiment the rotary sealing element includes a plug which depends from the cap top which engages the interior of the container neck and maintains sealing contact until lhe cap has been unthreaded to the point where the webs have fractured releasing the frangible band. In some embodiments a fitment may be snapped over the container neck to provide a specific orifice size for the product being dispensed, and the cap plug will engage an interior surface of the fitment.

In another embodiment, lhe rotary sealing member includes an inwardly directed bead on the cap skirt which engages a cylindrical sealing surface on the container neck. This bead can be above or below the internal cap threads to engage such a cylindrical surface above or below the threads on the container neck.

In still another embodiment the rotary sealing member can take the form of a cylindrical surface on the cap skirt which engages an outwardly extending bead on the container neck. The bead on the container neck can be above or below the threads to engage the complementary cylindrical surface in the cap above or below the internal cap threads.

BRIEF DESCRIPTION OF THE DRAWING

The preferred embodiments of the invention are illustrated in the drawings in which.

DESCRIPTION OF THE PREFERRED EMBODIMENTS

Figure 1:
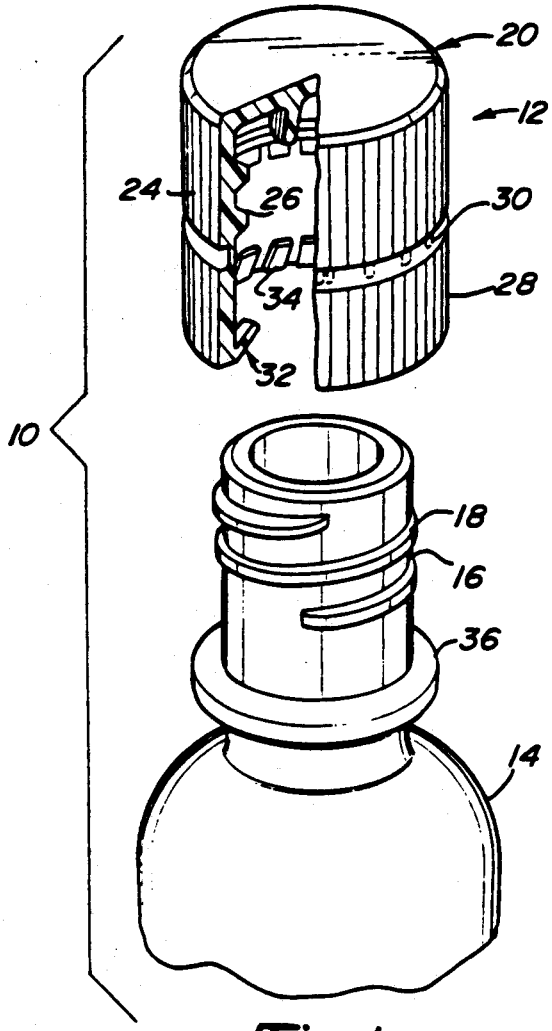
FIG. 1 is an exploded perspective view of the closure of this invention showing its application to a container so that the rotary seal of the closure engages the inside of the container neck.
Figure 2:
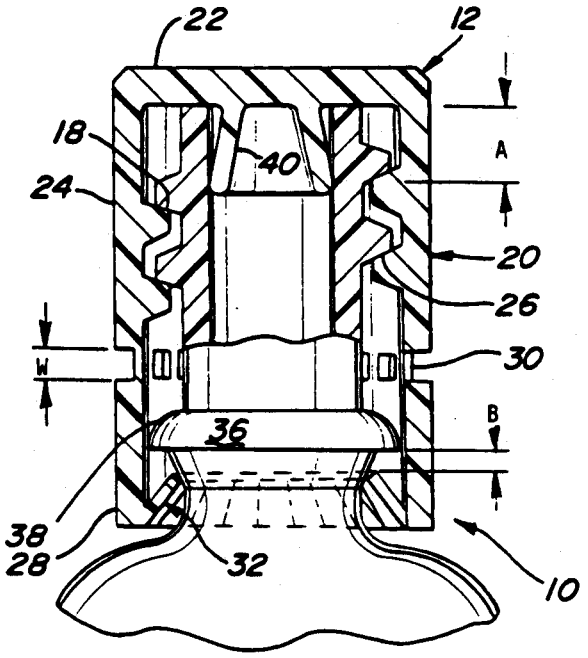
FIG. 2 is a vertical-sectional view of the closure of FIG. 1 showing it in a fully tightened or fully threaded position on the container.
Figure 3:
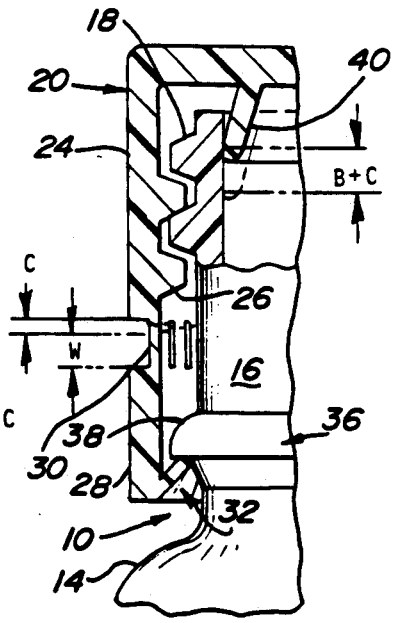
FIG. 3 is a partial vertical-sectional view of the closure of this invention as shown in FIGS. 1 and 2 showing the closure in a position on the container neck as it is being unthreaded from the container wherein the frangible webs between the cap and the tamper indicating band have been stretched to the breaking point.

Referring to FIGS. 1–3, the closure-container package 10 includes closure 12 and container 14 having a neck 16 with an external helical thread 18. The closure 12 includes a cap 20 having a flat top 22 and a cylindrical skirt 24 with internal threads 26 complementary to container neck threads 18. Closure 12 has a tamper indicating band 28 which depends from the bottom of the cap skirt and is connected thereto by frangible webs 30. The tamper indicating band 28 has an inwardly directed bead 32 at its bottom edge shown as being segmented in FIGS. 1–3 or including a plurality of upwardly and inwardly directed fingers 34 which engage or snap over outwardly directed flange 36 on the container neck. The fingers 34 are flexible and push inwardly as they engage the container neck threads and lhe rounded surface 38 of container flange 36 so as to easily snap over the flange when the cap is being threaded onto the container neck. With the cap in its fully threaded on or tightened condition, the bead 32 is a distance B below the container neck flange 36 as shown in FIG. 2. As the cap is being initially unthreaded, the top of the bead 32 will contact the bottom of flange 36 to resist any further axial movement of the band 28 so that the webs 30 will be stretched a distance C as shown in FIG. 3 until they are finally fractured, separating the band from the cap to indicate tampering or initial opening of the package 10.

Repeated testing of tamper indicating closures of this type supplied with conventional gasket or plug seals reveals that the cap can be turned at least 270°–360° before web breakage which occurs with a stretch C equal to approximately 0.062 inches, and that copious leakage occurs with a half turn of 180° or B equals 0.062 inches which is the point at which the top of the bead makes contact with the bottom of the container neck flange. In fact, leakage occurs between 45° to 90° or with an axial movement of 0.016 to 0.031 inches. This allows easy removal of a portion of the product by squeezing the plastic bottle, and for refilling the removed volume with water using the partial vacuum created in the removal to suck in the diluent. Even where the seal is maintained for a relatively little twist of the cap, for example where four ratchet teeth are used on both the band and container neck and contacting could occur with an unthreading rotation of less that 45°, the seal can be broken by squeezing pressure applied to the container. The closure of the present invention includes a rotary seal which is designed to prevent access to the product prior to breakage of the tamper indicating ring. The integrity of the seal is maintained during unthreading of the closure for over one full turn or for an axial movement exceeding 0.125 inches. Preferably the seal is maintained for a distance A which is greater than B+C, and preferably is at least 3/16" to ¼".

In the embodiment of FIGS. 1—3, the rotary sealing element takes the form of a plug 40 which depends from the cap top 22 to engage the interior of the container neck 16. As seen in FIG. 2, the seal will be maintained for a distance A from the fully closed or threaded on position of the cap until after fracture of the frangible webs 30 which occurs after they have been stretched a distance C as shown in FIG. 3. The distance A is always greater than B+C. The plug 40 can have a conical or diverging surface as most clearly shown in FIGS. 2 and 3.

When the rotary sealing element is in the form of a plug, squeezing pressure applied to the container increases the sealing pressure of the plug against the interior of the container neck, further assuring the thwarting of an attempt to remove liquid before the tamper indicating band has been broken free.

Figure 4:
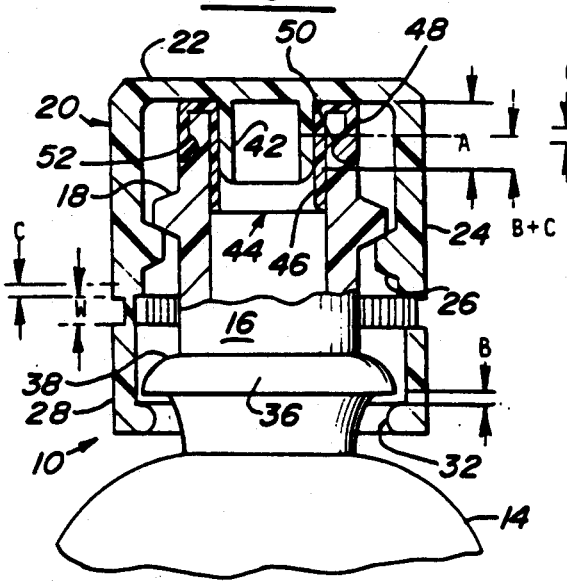
FIG. 4 is a vertical-sectional view of another embodiment of the invention wherein a two-piece closure includes a cap and a fitment for attachment to the container showing the cap in its fully threaded or tightened position but also showing the amount the frangible webs will have to be stretched to reach their fracture point; the rotary seal of the cap engages a cylindrical surface on the fitment which is in contact with the inside of the container neck.

In other embodiments such as that shown in FIG. 4, the plug 42 can be cylindrical having an interference fit with the inside diameter of the neck 16 or the inside diameter of a fitment 44 as shown in FIG. 4. The fitment 44 has an inner skirt 46 which sealingly engages the interior of neck 16 and an outer skirt 48 which engages the outside diameter of the neck. An inwardly directed snap bead 50 at the bottom of outer skirt 48 coacts with a groove 52 in the neck 16 to retain the fitment on the container after initial opening. The fitment 44 is normally supplied with the closure 12, being retained in the cap 20 by a slight interference fit between the plug 42 and the inner skirt 44. When the container has been filled with a product, the initial capping of the closure 12 to the container 14 will snap the insert 44 permanently in place on the container neck. The fitment 41 is normally used to reduce the neck opening to a smaller dispensing orifice size.

Figure 5:
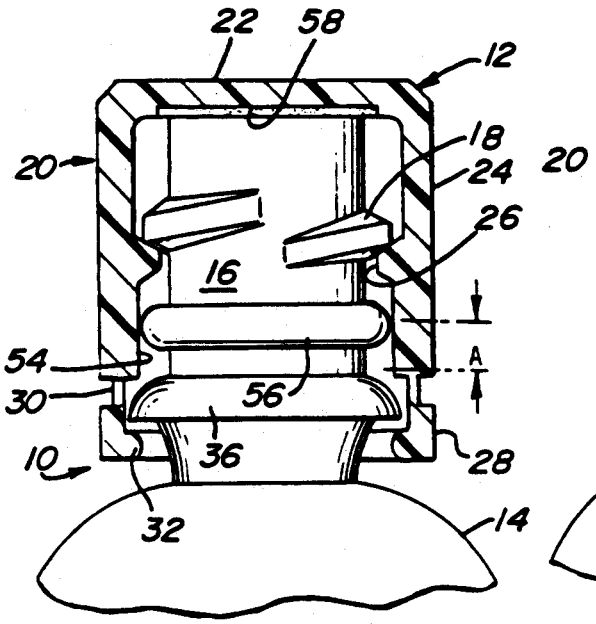
FIG. 5 is a cross-sectional elevational view similar to FIGS. 2 and 4 showing another embodiment of the invention in which the rotary sealing element on the container neck is below lhe container neck threads engaging an axially extending cylindrical sealing surface on the cap.
Figure 7:
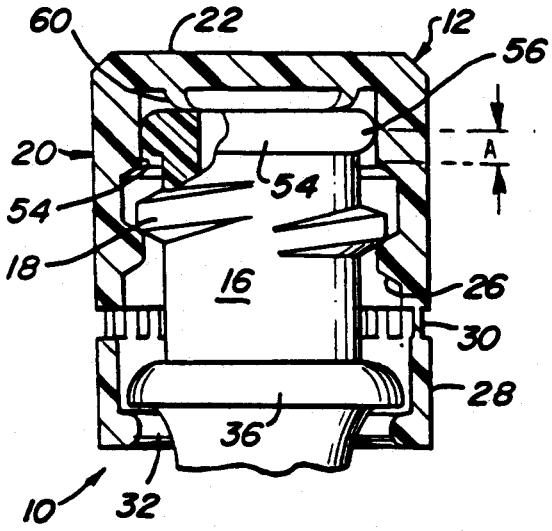
FIG. 7 is a cross-sectional elevational view similar to FIGS. 2, 4 and 6 showing still another embodiment of the invention in which the rotary seal is located on the container neck above the container neck threads.

In the embodiment of FIG. 5, the rotary sealing member includes an uninterrupted cylindrical sealing surface 54 on the inside of cap skirt 24 having a minimum length A for continuous sealing contact with an outwardly extending sealing bead 56 on container neck 16. The sealing surface 54 can be below the cap threads 26 as the embodiment of FIG. 5 or it can be above the cap threads 26 coacting with an outwardly extending sealing bead 56 on the container neck above the container threads 18 as shown in FIG. 7. A secondary seal in the form of gasket 58 is used to seal right at the container neck lip which provides a seal when the cap 20 is replaced on the container neck. In the embodiment of FIG. 7 this secondary seal takes the form of a downwardly extending flange or fin 60.

Figure 6:
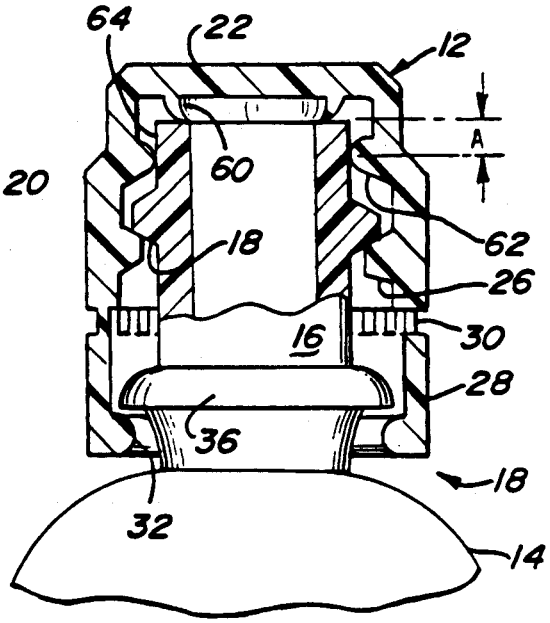
FIG. 6 is a cross-sectional elevational view similar to FIGS. 2, 4 and 5 showing another embodiment of the invention in which the rotary seal is located on the closure above the closure threads.

Likewise the rotary sealing member can include an inwardly directed bead 62 on the closure cap 20 above or below the cap threads 26 which coacts with an external cylindrical sealing surface 64 which is on the container neck having a length of at least A. which is greater than the sum B+C. FIG. 6 shows an inwardly directed bead 62 on the closure 20 above cap threads 26 which coacts with the external cylindrical sealing surface 64 on container neck 16 above neck threads 18.

Figure 8:
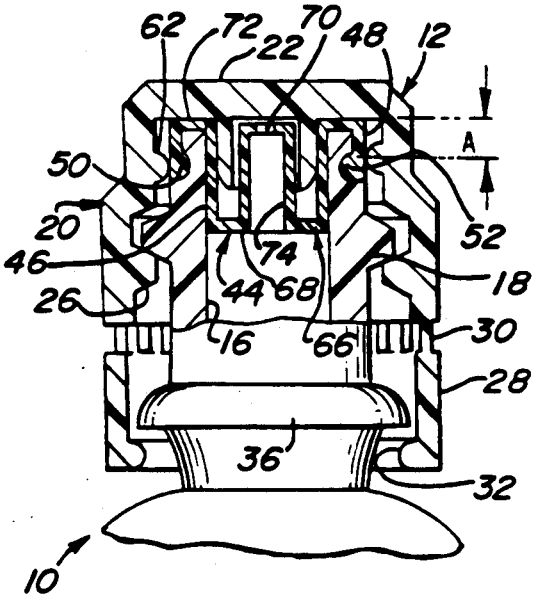
FIG. 8 is a cross-sectional elevational view of the closure of this invention showing another embodiment of the invention similar to that of FIG. 6 employing a two-piece closure with a cap and fitment similar to FIG. 3 for attachment to a container in which there are two rotary seals on the cap which engage cylindrical sealing surfaces on the fitment.

In the embodiment of FIG. 8, a fitment 66 is used similar to fitment 44 in FIG. 4. In this embodiment bottom wall 68 of the fitment defines a smaller orifice 70 for dispensing lhe container's contents. Like the embodiment of FIG. 4, cylindrical sealing plug 42 forms the rotary sealing member which coacts with the inside fitment wall 46 over the axial length A. In addition, a secondary rotary sealing element is provided in the form of an inwardly projecting bead 62 similar to that used in FIG. 6 which cooperates with the fitment outer skirt cylindrical surface 48, again providing a seal over the axial length A. Top surface 72 of the insert can also act as a secondary seal surface at the container neck lip.

In the embodiments of FIGS. 4–8, the inwardly directed bead 32 at the bottom of the tamper indicating band 28 is shown as a circumferentially continuous bead, but it can be segmental since it does not perform a sealing function.

Figure 9:
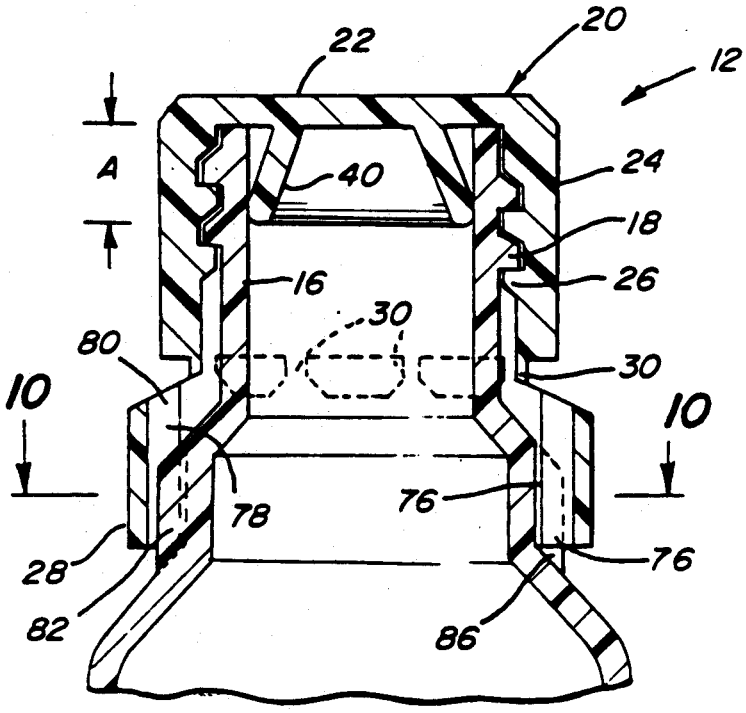
FIG. 9 is a vertical-sectional view of another embodiment of the closure showing the same type of rotary sealing element as the embodiment of FIG. 2 but with the use of ratchet teeth on the tamper indicating band and container neck replacing the inwardly projecting bead on the tamper indicating band and the outwardly directed flange on the container neck employed in the embodiments of FIGS. 2–8; the closure is shown in its fully tightened or fully threaded position on the container.
Figure 11:
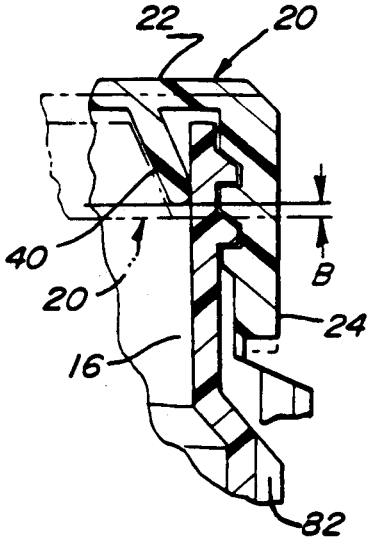
FIG. 11 is a fragmentary elevational view of the closure of FIGS. 9 and 10 showing the position of the cap relative to the container neck after the cap has been unthreaded so that the stop surfaces of the ratchet teeth on the tamper indicating band are in contact with the stop surfaces on the ratchet teeth of the container as shown in FIG. 10 and showing a portion of the cap in phantom in its fully tightened position with the indication of the axial distance B that the cap will move as it is twisted open to the stop position.
Figure 10:
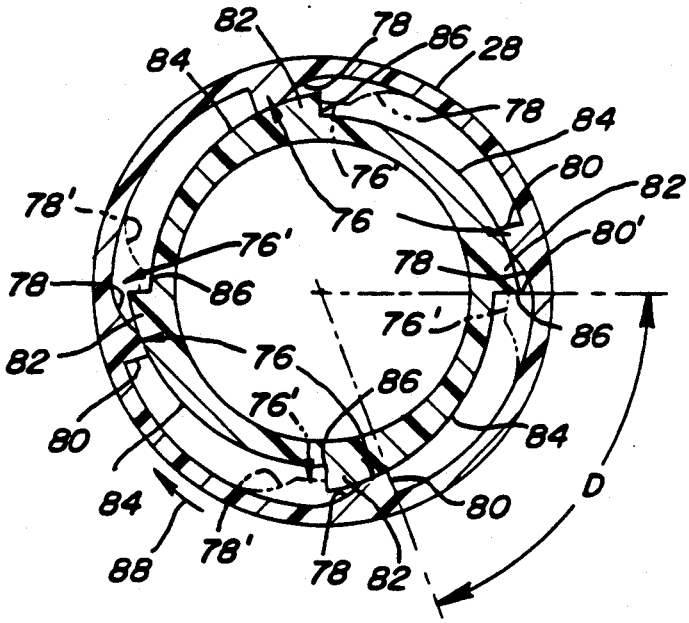
FIG. 10 is a cross-sectional view taken along line 10—10 in FIG. 9 showing the ratchet teeth of the band in a fully tightened position of cap 20 and showing the ratchet teeth in phantom after the cap has been rotated through an angle D so that the stop surfaces on the tamper indicating band ratchet teeth are abutting the stop surfaces on the container neck ratchet teeth.

In the embodiment of the closure shown in FIGS. 9–11, the same type of rotary sealing element is used as that shown in FIGS. 2 and 3 which takes the form of a conical or diverging surface plug 40 which seals against the inside surface of container neck 16. The inwardly directed bead on the tamper indicating band has been replaced by circumferentially spaced inwardly directed ratchet teeth 76, shown as four equally spaced teeth, which coact with corresponding ratchet teeth 82 on the container neck which replace the container neck flange 36 of the embodiments of FIGS. 1–8. As the cap is being threaded onto the container neck in the direction of arrow 88 in FIG. 10 the cam surfaces 78 of tamper indicating band ratchet teeth 76 slide over the cam surfaces 84 of container ratchet teeth 82 so that the band ratchet teeth 76 come to rest in the position shown in FIG. 10 in the fully threaded on position of the cap. When the cap is twisted in the opposite direction to unthread the cap from the container neck it will move through an angle D as shown in FIG. 10 before the stop surfaces 80 of the band ratchet teeth 76 come into abutting contact with the stop surfaces 86 of the container neck ratchet teeth 82 as shown by the phantom position 76' of the band ratchet teeth. In moving through the angle D, the cap is raised an axial distance B from its fully tightened position as shown if FIG. 11 where the tightened position of the cap is shown in phantom at 20'. The abutting of the band ratchet teeth with the container neck ratchet teeth prevents further rotation of the tamper indicating band 28 so that the frangible webs 30 will be stretched to the their fracture or failure point.

We claim:

1. A threaded tamper indicating closure for use on a container having a threaded neck and stop means below its threads, said closure comprising:

a cap having a top and an annular skirt depending from said top with internal threads complementary to said container threads;

a tamper indicating band spaced from the bottom of said cylindrical skirt and connected thereto by a plurality of circumferentially spaced axially extending frangible webs;

engagement means on said band which permits rotation of said band with said cap as said cap is being threaded onto said container by allowing said engagement means to pass over said container stop means to the point where said closure is fully threaded onto said container neck where said engagement means is spaced from said container stop means, said engagement means contacting said stop means as said cap is being unthreaded, and said webs are stretched to their fracture point by retention of said engagement means by said container stop means; and a rotary sealing member on said cap in the form of a cylindrical surface on said annular cap skirt which maintains sealing contact with an outwardly extending bead on said container neck until after said cap has been unthreaded to the point where said webs fracture.

2. The threaded tamper indicating closure according to claim 1 wherein said engagement means includes an inwardly projecting bead.

3. The threaded tamper indicating closure according to claim 2 wherein said inwardly projecting bead is segmented.

4. The threaded tamper indicating closure according to claim 3 wherein said inwardly projecting segmented bead includes a plurality of circumferentially spaced fingers extending inwardly and upwardly from the bottom of said tamper indicating band.

5. The threaded tamper indicating closure according to claim further including a fitment engaging said container neck and having a dispensing orifice therein.

6. The threaded tamper indicating closure according to claim 1 wherein said cylindrical surface is above said internal threads.

7. The threaded tamper indicating closure according to claim 1 wherein said cylindrical surface is below said internal threads.

8. The threaded tamper indicating closure according to claim 1 wherein said engagement means includes a plurality of circumferentially spaced ratchet teeth, at least one of said ratchet teeth contacting said stop means as the cap is being unthreaded.

9. The threaded tamper indicating clossure according to claim 8 wherein said ratchet teeth on said band are inwardly projecting to engage outwardly projecting ratchet teeth on said container neck.

10. A threaded tamper indicating closure for use on a container having a threaded neck and stop means below its threads, said closure comprising:

a cap having a top and an annular skirt depending from said top with internal threads complementary to said container threads;

a tamper indicating band spaced from the bottom of said cylindrical skirt and connected thereto by a plurality of circumferentially spaced axially extending frangible webs;

a fitment having an annular inner skirt which engages the interior of said container neck and an outer skirt concentric with and circumposing said annular inner skirt, said outer skirt having an inwardly directed bead which snaps on said container neck;

engagement means on said band which permits rotation of said band with said cap as said cap is being threaded onto said container by allowing said engagement means to pass over said container stop means to the point where said closure is fully threaded onto said container neck where said engagement means is spaced from said container stop means, said engagement means contacting said stop means as said cap is being unthreaded, and said webs are stretched to their fracture point by retention of said engagement means by said container stop means; and a plug on said cap which maintains sealing contact with the annular inner fitment skirt and an inwardly directed bead on said cap skirt which maintains sealing contact with the exterior surface of the outer surface of said fitment outer skirt, both of said sealing contacts being maintained from the fully threaded position of said cap on said container neck until after said cap has been unthreaded to the point where said webs fracture.

* * * * *